United States Patent [19]

Hayes

[11] 4,384,671

[45] May 24, 1983

[54] TEMPERATURE RESPONSIVE VENT DAMPER

[75] Inventor: Thomas E. Hayes, Goshen, Ind.

[73] Assignee: Johnson Controls, Inc., Milwaukee, Wis.

[21] Appl. No.: 300,034

[22] Filed: Sep. 8, 1981

[51] Int. Cl.[3] ..... G05D 23/08

[52] U.S. Cl. ..... 236/1 G; 236/93 R

[58] Field of Search ..... 236/1 G, 93 R, 101 E; 137/527, 855; 126/292; 431/20

[56] References Cited

U.S. PATENT DOCUMENTS

| | | | |
|---|---|---|---|
| 199,696 | 1/1878 | Dikeman | 137/527 X |
| 3,845,783 | 11/1974 | De Lepeleire | 137/527 X |
| 4,143,812 | 3/1979 | Fortune | 236/93 R X |
| 4,249,694 | 2/1981 | Diermayer et al. | 236/101 E X |
| 4,301,833 | 11/1981 | Donald | 137/527 X |

*Primary Examiner*—William E. Tapolcai

*Attorney, Agent, or Firm*—Emrich, Lee, Brown & Hill

[57] ABSTRACT

A heater vent having a temperature responsive damper such as a bimetallic element is disclosed. A shroud-like structure is positioned to cooperate with the temperature responsive element to close the vent at an elevated temperature and thereby reduce loss of residual heat while permitting the combustion gases to be completely purged from the firebox. For safety, movement of the temperature responsive element is uninhibited in all positions with complete vent closure occurring at ambient temperature and with the damper open during heater burner operation.

12 Claims, 4 Drawing Figures

TEMPERATURE RESPONSIVE VENT DAMPER

BACKGROUND OF THE INVENTION

This invention generally relates to vent dampers and more specifically is directed to a vent damper having a temperature responsive element for reducing vent heat loss.

Conventional domestic heating systems include a flue, or exhaust stack, which may incorporate a damper for the reduction of heat loss. These dampers may be manually or automatically operated. During periods in which the furnace is off, the damper closes the flue to prevent heat loss up the flue through convection. In addition, the damper is intended to trap the heat of the furnace after furnace shut-off so that this residual heat is available for delivery to the space being heated rather than lost up the flue. However, damper operation must be delayed until the noxious combustion products are purged from the fire box. If this delay is electrically or mechanically actuated, the damper closing may vary with ambient and/or operating conditions. If the closing is temperature-responsive and does not occur until the flue temperature falls to room ambient temperature, too much heat is sacrificed because the combustion products will long since have been purged.

According to a recent government study, damper flue closure when the furnace is off accounts for approximately 20% of energy saved by the damper. A more substantial contribution to heat loss reduction by the damper, the remaining 80%, occurs immediately after furnace turn-off due to damper closure. Thus, substantially more heat is lost over a relatively short period of time following furnace turn-off than over the longer periods between furnace operation because of the high furnace operating temperatures.

Conventional dampers are generally either motor driven or temperature responsive. The former damper employs an electric motor which is controlled by a temperature sensor for mechanically closing the flue following furnace shut-off. This damper approach is expensive in the original cost of components, cost of installation and cost of repair and maintenance.

While the temperature responsive element type of damper generally offers the advantages of lower cost and reduced complexity, this approach too suffers from performance limitations. The typical vent damper employing a bimetallic actuator as the temperature responsive element acts to close the flue only when the temperature of the actuator reaches ambient. This permits the escape of substantial amounts of residual heat between furnace operating cycles, considering a system operating at a normal six cycles per hour. This loss is due to the inability of the bimetallic actuator to completely close even though the firebox is purged of combustion products because the presence of residual heat between cycles maintains the bimetallic actuator open just enough to permit the loss of residual heat.

U.S. Pat. No. 3,228,605 to Diermayer et al. discloses an automatic flue damper having a temperature responsive element consisting of a slotted bimetallic damper plate normally extending across the flue duct. The plate is divided by the slots into longitudinal strips with one end of each strip fixedly attached to the duct with the strips located in a common plane at normal temperature. With an increase in temperature, the free end of each strip moves arcuately away from a fixed duct element and gradually opens a passage for the hot flue gases. In this configuration, the bimetallic strips will not assume a completely closed position across the duct until ambient temperature is reached following burner shut-off resulting in the loss of residual heat via the flue.

U.S. Pat. No. 3,510,059 to Diermayer et al. discloses a flue damper arrangement intended primarily to provide for rapid vent opening following burner ignition. In this approach, the circular flue conduit is divided into four 90° sectors formed by partitions extending across the conduit perpendicular to the direction of gas flow. To each partition is connected a damper section in the form of a one-quarter circle which includes elongated, transversely juxtaposed strips of laminated, bimetallic material extending substantially in a common plane transverse to the conduit axis when cold and defining longitudinal slots between each such quarter circle sector. One of the narrow edges of each strip is fixedly fastened to one wall of the corresponding passage section and the other narrow edge is free to move about the fixed portion in response to temperature change. When the damper section is deflected by rising temperature, a flow passage opens between the aforementioned longitudinal edge and the closely juxtaposed partition at a rate approximately proportional to the increase in the angle of deflection. This configuration allegedly allows for the rapid opening of the flue passage in response to increasing exhaust gas temperatures, but fails to address the problem of reducing heat loss following burner shut down.

SUMMARY OF THE INVENTION

The present invention includes a temperature responsive element, such as a bimetallic plate, positioned in the vent of a heating system so as to assume a continuum of positions between a full closed position (when the plate is at the ambient temperature) to a full open position (at normal heating cycle temperatures). The plate is fixed along one edge while another edge is free to move in defining an arc according to the shape of the plate, or blade (which is not critical). A continuous structural member, or shroud, is mounted to the damper housing and cooperates with the free edge of the temperature responsive element to close the vent at a predetermined temperature above ambient. As vent temperature decreases from a normal heating cycle operating temperature following heating system shut-off, the plate moves about its fixed edge from the full open position toward the full closed position. When a predetermined temperature is reached indicative of complete purging of combustion gases from the firebox, e.g., 225° F., the free edge of the temperature responsive element is positioned adjacent the shroud to seal the vent. The shape of the shroud conforms to the path of the free edge of the blade which is free to move as the temperature continues to decrease toward ambient while maintaining the vent in a substantially closed state until ambient temperature is reached. With the heating system's burner in operation, the temperature responsive element is displaced from the shroud thus opening the vent for required combustion ventilation.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with the accompanying drawings, where like reference characters identify like elements in the several figures, in which:

DESCRIPTION OF THE PREFERRED EMBODIMENTS

Figure 1:
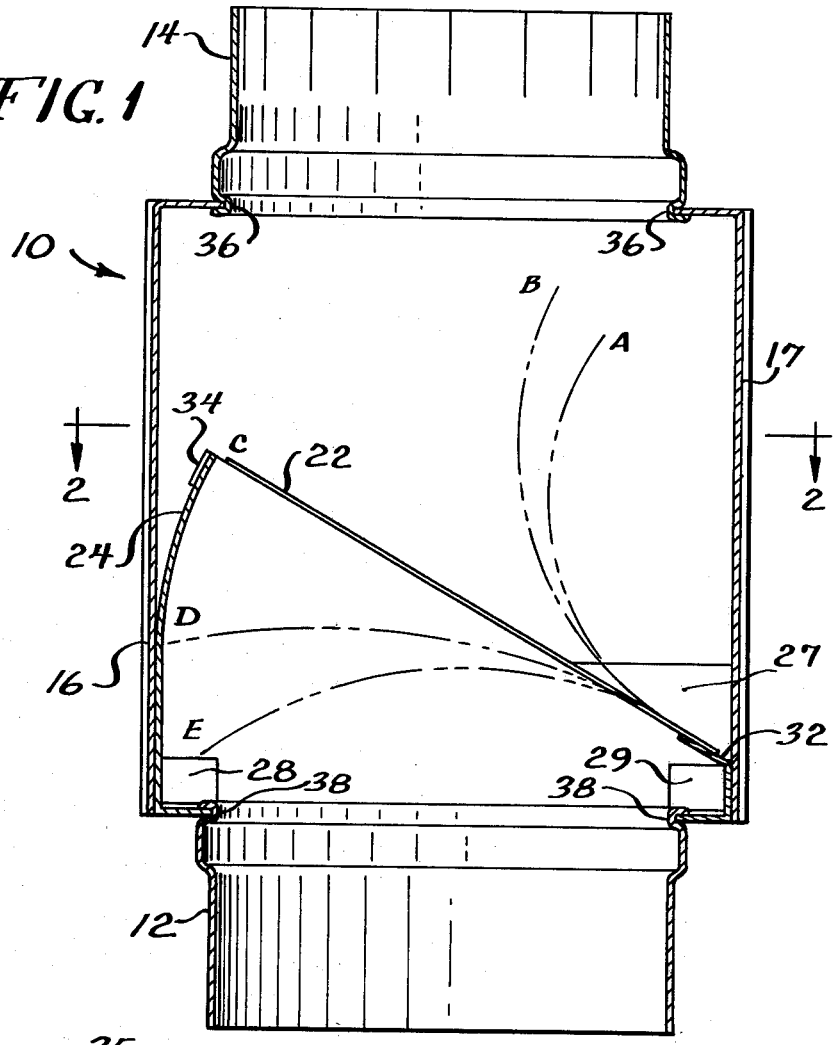
FIG. 1 is a cross sectional view of one embodiment of a temperature responsive vent damper in accordance with the present invention.
Figure 2:
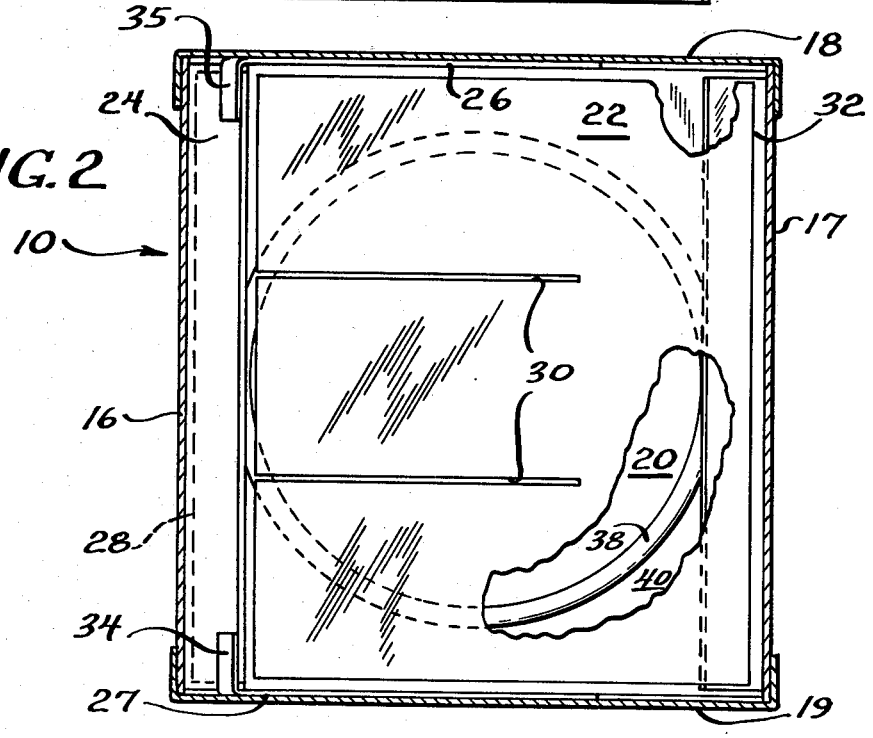
FIG. 2 is a partially cut away top view of the temperature responsive vent damper of FIG. 1.

Referring to FIG. 1, there is shown a cross sectional view of one embodiment of a temperature responsive vent damper 10 in accordance with the present invention. Damper 10 includes a housing comprised of a first pair of facing sidewalls 16 and 17 coupled to a second pair of facing sidewalls 18 and 19, which are shown in FIG. 2. First and second pairs of facing sidewalls 16 and 17 and 18 and 19 define an aperture which is continuous with the apertures defined by lower and upper vent sections 12 and 14 to which the lower and upper portions of damper 10 are respectively coupled in a conventional manner. As shown in FIG. 1, damper 10 is supported by upper vent section 14 while lower vent section 12 is supported by damper 10 housing.

Positioned adjacent the lower portion of the interior surface of each of the first pair of facing sidewalls 16 and 17 of damper 10 are tip shroud 24 and mounting base 32. Tip shroud 24 and mounting base 32 are connected to facing sidewalls 16 and 17, respectively, in a conventional manner, such as by spot welding. The lower horizontal portions of the tip shroud 24 and mounting base 32 contact lower vent section 12 and are joined thereto by means of a lower vent section crimped coupling edge 38. In a similar manner, an upper vent section crimped coupling edge 36 is formed from the lower edge of upper vent section 14 so as to engage horizontal portions of first and second pairs of facing sidewalls 16, 17 and 18, 19. Damper base elements 28 and 29 are inserted adjacent the lower portions of tip shroud 24 and mounting base 32, respectively, and are secured thereto in a conventional manner, such as by spot welding. Damper base elements 28 and 29 thus hold tip shroud 24 and mounting base 32, and thus the base 40 of damper 10 housing, in fixed relation to the crimped edge 38 of lower vent section 12 in maintaining structural rigidity for support and vent continuity purposes.

In accordance with the present invention, temperature responsive element 22 is coupled to mounting base 32 so as to project out into the aperture defined by first and second pairs of facing sidewalls 16, 17 and 18, 19. Element 22, which is generally in the shape of a flat plate, responds to changes in temperature by changing its radius of curvature. FIG. 1 shows temperature responsive element 22 in various configurations labeled A, B, C, D, and E. Each of the curvilinear shapes of temperature responsive elements 22 shown in FIG. 1 represent a particular temperature in damper 10. Variably configured materials such as temperature responsive element 22 are well-known in the art and generally are comprised of a bimetallic, spring-like material. The characteristics of temperature responsive element 22 are determined by the metallic strips used in its fabrication and may be selected to ensure that its shape at each of the five various locations shown in FIG. 1 corresponds to one of five distinct temperatures. In the present invention, temperature responsive element 22 preferably assumes position A at a temperature of 520° F., position B at 460° F., position C at 200° F., position D at 80° F., and position E at 0° F. Temperature responsive element 22 is affixed to mounting base 32 in a conventional manner such as by spot welding.

Tip shroud 24 is positioned in facing relation to mounting base 32 and temperature responsive element 22 on the opposite facing sidewall of damper 10 therefrom. As previously described, the lower portion of tip shroud 24 is securely coupled to one of the pair of facing sidewalls 16 while its upper portion extends away from sidewall 16 into the aperture defined by the sidewalls 16, 17 and 18, 19 of damper 10. Tip shroud 24 is comprised of a solid, continuous sheet of material, preferably of metal, which extends between the second pair of facing sidewalls 18 and 19. The upper portion of tip shroud 24 extending into the aperture of damper 10 is located therein such that at a first predetermined temperature it is in close proximity to the free end of temperature responsive element 22 (at position C). Tip shroud 24 is shaped such that as the temperature is reduced the free end of temperature responsive element 22 closely tracks the concave surface of tip shroud 24 which faces the aperture of damper 10. This is shown as position D of temperature responsive element 22 in FIG. 1. Although the free end of temperature responsive element 22 is in close proximity to the inner, concave surface of tip shroud 24, temperature responsive element 22 does not contact tip shroud 24 in compliance with damper freedom of movement safety criteria. Temperature responsive element 22 is further provided with slots 30 which permit the venting of noxious gases during periods of burner shutoff such as when only the heater's pilot flame is ignited.

At still lower temperatures the curvature of temperature responsive element 22 increases causing the free end of temperature responsive element 22 to be in contact with damper base element 28. When this occurs the heating system's vent is completely obstructed by temperature responsive element 22 thus preventing heat loss therethrough. Positions A and B of temperature responsive element 22 represent high temperature situations when the heating system's burner is in operation and maximum venting is required. The present invention takes advantage of the fact that in a conventional domestic furnace at burner cut-off the necessarily thin, blade-like structure of temperature responsive element 22 undergoes an immediate, large displacement in a counterclockwise direction as shown in FIG. 1 because the flue gas temperature drops from 350° F. during firing to 175° F. in less than ten seconds. The present invention, by positioning tip shroud 24 in close proximity to the moving edge of temperature responsive element 22 throughout most of the temperature reduction period, substantially reduces vent heat loss during this critical period of potentially great heat loss.

Tip shroud 24 is connected to shroud lateral sections 26 and 27 which are positioned adjacent to opposing edges of temperatures responsive element 22 and immediately adjacent to the second pair of facing sidewalls 18 and 19. A small gap is provided between temperature responsive element 22 and shroud lateral sections 26 and 27 to permit the free movement of temperature responsive element 22 therebetween. Shroud brackets 34 and 35 are rigidly coupled to shroud lateral sections 27 and 26, respectively, and to tip shroud 24 for further reinforcing of the shroud assembly.

Figure 3:
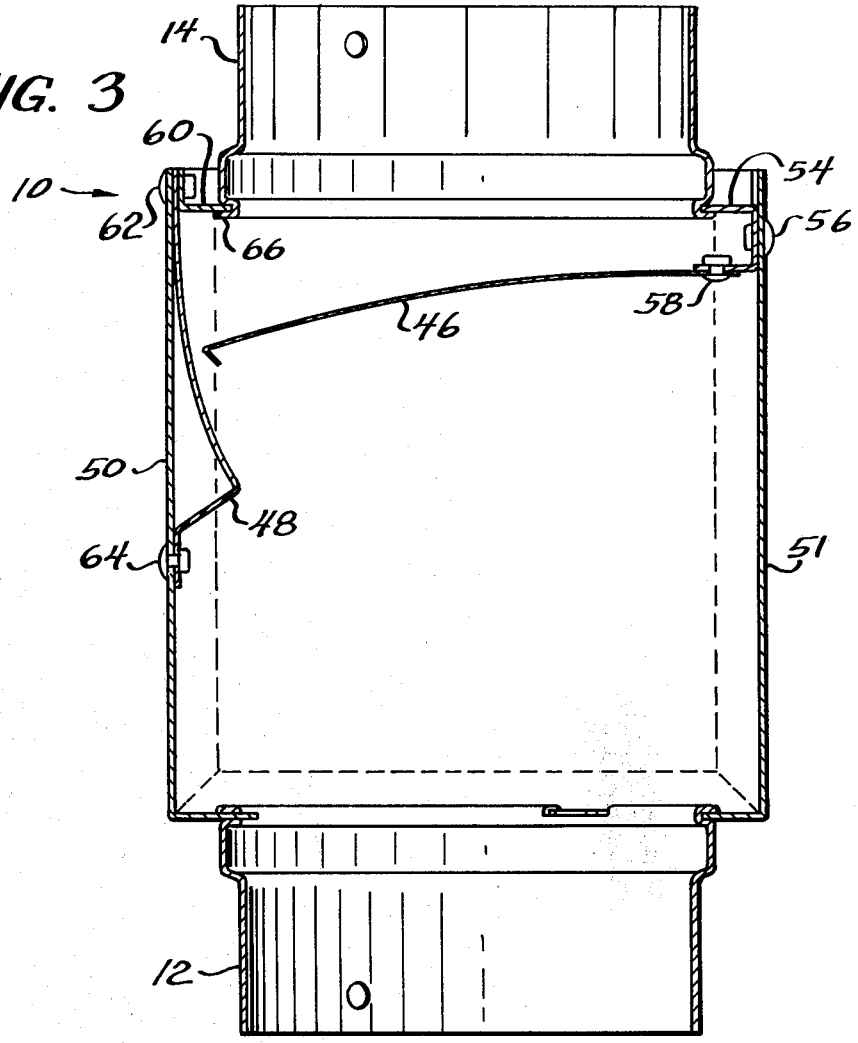
FIG. 3 is a cross sectional view of a temperature responsive vent damper in accordance with the preferred embodiment of the present invention.
Figure 4:
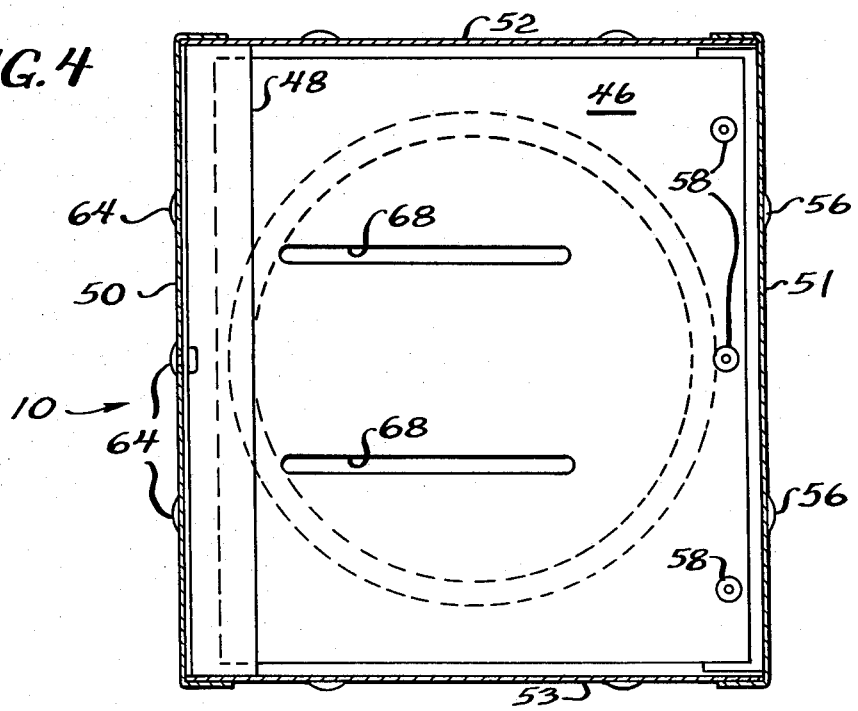
FIG. 4 is a partially cut away bottom view of the preferred embodiment of the temperature responsive vent damper of FIG. 3.

Referring to FIG. 3, there is shown a cross-sectional view of the preferred embodiment of a temperature responsive vent damper 10 in accordance with the present invention. A first pair of facing sidewalls 50, 51 are respectively coupled to and provide support to tip shroud 48 and U-shaped mounting bracket 54 to which temperature responsive element 46 is securely connected by means of a plurality of rivets 58. Tip shroud 48 is secured to sidewall 50 by means of rivets 62, 64 and U-shaped mounting bracket 54 is affixed to sidewall 51 by means of rivets 56. The first pair of facing sidewalls 50, 51 in combination with a second pair of facing sidewalls 52, 53, as shown in FIG. 4, define an aperture which is continuous with the apertures defined by lower and upper vent sections 12, 14. As shown in FIG. 3, the sidewalls of temperature responsive vent damper 10 are connected directly to lower vent section 12 in a conventional manner. The sidewalls of temperature responsive vent damper 10 are coupled to upper vent section 14 by means of L-shaped mounting bracket 60 and U-shaped mounting bracket 54. Tip shroud 48, L-shaped mounting bracket 60, temperature responsive element 46, and U-shaped mounting bracket 54 extend the entire length of facing sidewalls 50, 51 and are securely mounted over the entire length thereof. Slots 68 are incorporated in temperature responsive element 46 for stress relief and for providing at least a certain minimum updraft through the vent at all times.

As in the earlier description of another embodiment of the invention, the free end of temperature responsive element 46 moves in close proximity to the curved portion of the shroud 48 in maintaining the substantial closure of the vent over a temperature range extending above ambient temperature, and preferaby up to approximately 200° F. With the free end of temperature responsive element 46 in close proximity to the innermost portion of tip shroud 48 at this elevated temperature, an increase in temperature will cause the further bending of temperature responsive element 46 resulting in the opening of the vent for permitting the escape of the unwanted by-products of combustion. A reduction in internal vent temperature causes the free end of temperature responsive element 46 to once again assume a position in close proximity to the curved portion of tip shroud 48. A further reduction in vent temperature causes the free end of temperature responsive element 46 to approach L-shaped mounting bracket 60 with firm contact established between the free end of temperature responsive element 46 and closure point 66 at a predetermined reduced temperature. In the preferred embodiment of the present invention, this reduced temperature is approximately 0° F. Thus, the various positions A–E that temperature responsive element 46 assumes over a predetermined temperature range as shown in FIG. 1, also apply, with the free end movement in the opposite direction, to FIG. 3 to show similar temperature-dependent positions of temperature responsive element 46.

The preferred embodiment of the present invention is shown in FIGS. 3 and 4. This embodiment has several advantages over the embodiment depicted in FIGS. 1 and 2 including the use of fewer parts and the downward vent opening direction of movement of temperature responsive element 46. Thus, in the event foreign matter is introduced into and passes down through upper vent section 14, the embodiment shown in FIGS. 3 and 4 will permit it to pass through the damper section of the vent without forcing temperature responsive element 46 into the full closed position and thereby completely blocking the vent. Finally, while in its preferred embodiment as shown in FIGS. 3 and 4 rivets are used for securing various members together, any of the more conventional coupling means, such as spot welding, could be utilized in practicing the present invention.

There has thus been described a heat conserving vent damper for use in a conventional heating system. By taking advantage of the increased sensitivity of a temperature responsive element at high temperatures, the damper is configured to substantially close the vent at an elevated temperature following heater cut-off followed by complete vent closure at a lower temperature to minimize vent heat loss.

Changes in construction will occur to those skilled in the art and various apparently different modifications and embodiments may be made without departing from the scope of the invention. For example, the present invention is described in terms of damper 10 housing being rectangular in shape. However, the present invention is not limited to this configuration since any of the more conventional damper cross sectional shapes could be used in the present invention. The only requirement here is that the geometry of temperature responsive element 22 match that of damper 10 housing with a complementary shape provided to tip shroud 24 and shroud lateral sections 26 and 27. Also, while the present invention has been explained in terms of tip shroud 24 having one end securely fastened to damper 10 housing with the other end projecting into the aperture defined by the sides of vent 10, it again is not limited to this configuration. Tip shroud 24 may take on any shape which extends into the aperture defined by the sides of vent 10 housing and which includes a continuous surface of solid material closely positioned near the free end of temperature responsive element 22 at a first predetermined temperature and which remains in close proximity to that free edge over a considerable temperature range until complete vent closure occurs.

The matter set forth in the foregoing description and accompanying drawings is offered by way of illustration only and not as a limitation. The actual scope of the invention is intended to be defined in the following claims when viewed in their proper perspective against the prior art.

I claim:

1. In a heater vent through which the undesirable by-products of combustion are exhausted, a damper comprising:

a housing adapted to form a continuation of said vent and defining an aperture;

structural means fixedly positioned adjacent a first lateral portion of said housing and including a fixed shroud adjacent a portion of the edge of said housing and extending inwardly therefrom; and temperature responsive means having a first edge segment mounted to a second lateral portion of said housing in facing relation to said first lateral portion thereof and a free edge portion movable between a full closed position at a first relatively low temperature and at which position said temperature responsive means closes and seals said aperture, and a full open position of a second higher temperature and at which position said temperature responsive means opens said aperture to permit the flow of flue gases;

said shroud closely conforming to the path of said free edge portion of said temperature responsive means as it assumes a continuum of closed positions from said full closed position to an intermediate position representative of the position of said temperature responsive means at an intermediate temperature between said first and second temperatures.

2. The apparatus of claim 1 in combination with a gas heater wherein said intermediate temperature is representative of a temperature to which said vent gases decrease following a heating cycle of said heater while permitting combustion products to be vented through said aperture, said shroud and temperature responsive means thereafter cooperating to trap residual heat in said heater until the temperature of said gases approaches ambient temperature.

3. The apparatus of claim 1 wherein the free edge portion of said temperature responsive means is spaced closely adjacent said shroud.

4. The apparatus of claim 1 further comprising sealing means cooperating with said temperature responsive means at said first relatively low temperature so as to fully close and seal said aperture.

5. The apparatus of claim 1 wherein said temperature responsive means comprises a bimetallic plate.

6. The apparatus of claim 1 wherein said shroud comprises a rigid, curved member having a concave portion directed toward and extending into said aperture and forming a continuous surface, said continuous surface located in close proximity to the path of said free edge portion of said temperature responsive means from said full closed position to said intermediate position.

7. The apparatus of claim 1 further comprising mounting means securely coupling the first edge segment of said temperature responsive means to the interior of said housing.

8. The apparatus of claim 1 wherein the free edge portion of said temperature responsive means is displaced in a downward direction in moving from said full closed position to said full open position.

9. In a heater vent through which the undesirable by-products of combustion are exhausted, a damper comprising:

a housing adapted to form a continuation of said vent and defining an aperture;

structural means fixedly positioned adjacent a first lateral portion of said housing and including a fixed shroud adjacent a portion of the edge of said housing and extending inwardly therefrom;

sealing means fixedly mounted to said housing; and temperature responsive means having a first edge segment mounted to a second lateral portion of said housing in facing relation to said first lateral portion thereof and a free edge portion movable between a full closed position immediately adjacent said sealing means at a first relatively low temperature and at which position said temperature responsive means closes and seals said aperture, and a full open position at a second higher temperature and at which position said temperature responsive means opens said aperture to permit the flow of flue gases;

said shroud closely conforming to the path of said free edge portion of said temperature responsive means as it assumes a continuum of closed positions from said full closed position to an intermediate position representative of the position of said temperature responsive means at an intermediate temperature between said first and second temperatures, said intermediate temperature representing a temperature to which said vent gases decrease following a heating cycle of said heater while permitting combustion products to be vented through said aperture, said shroud and temperature responsive means thereafter cooperating to trap residual heat in said heater until the temperature of said gases approaches ambient temperature.

10. In a heater vent through which the undesirable by-products of combustion are exhausted, a damper comprising:

a housing adapted to form a continuation of said vent and defining an aperture;

structural means fixedly positioned adjacent a first lateral portion of said housing and including a fixed shroud adjacent a portion of the edge of said housing and extending inwardly therefrom;

sealing means fixedly mounted to said housing; and temperature responsive means having a first edge segment mounted to a second lateral portion of said housing in facing relation to said first lateral portion thereof and a free edge portion movable between a full closed position immediately adjacent said sealing means at a first relatively low temperature and at which position said temperature responsive means closes and seals said aperture, and a full open position at a second higher temperature and at which position said temperature responsive means opens said aperture to permit the flow of flue gases;

said shroud comprising a rigid, curved member having a concave portion directed toward and extending into said aperture as a continuous surface and conforming to the path of said free edge portion of said temperature responsive means and closely spaced therefrom as said temperature responsive means assumes a continuum of closed positions from said full closed position to an intermediate position representative of the position of said temperature responsive means at an intermediate temperature between said first and second temperatures, said intermediate temperature representing a temperature to which said vent gases decrease following a heating cycle of said heater while permitting combustion products to be vented through said aperture, said shroud and temperature responsive means thereafter cooperating to trap residual heat in said heater until the temperature of said gases approaches ambient temperature.

11. In a heater vent through which the undesirable by-products of combustion are exhausted, a damper comprising:

a housing adapted to form a continuation of said vent and defining an aperture;

structural means fixedly positioned adjacent a first lateral portion of said housing and including a fixed shroud adjacent a portion of the edge of said housing and extending inwardly therefrom; and temperature responsive means having a first edge segment mounted to a second lateral portion of said housing in facing relation to said first lateral portion thereof and a free edge portion downwardly movable between a full closed position at a first relatively low temperature and at which position said temperature responsive means closes and seals said aperture, and a full open position at a second higher temperature and at which position said temperature responsive means opens said aperture to permit the flow of flue gases;

said shroud closely conforming to the path of said free edge portion of said temperature responsive means as it assumes a continuum of closed positions from said full closed position to an intermediate position representative of the position of said temperature responsive means at an intermediate temperature between said first and second temperatures.

12. In a heater vent through which the undesirable by-products by combustion are exhausted, a damper comprising:

a housing adapted to form a continuation of said vent and defining an aperture;

shroud means fixedly mounted to said housing, said shroud means including an arcuate portion extending inwardly therefrom;

temperature responsive means having a first edge segment mounted to said housing and a free edge portion movable between a first position at a first relatively low temperature through an intermediate position at an intermediate temperature to a third position at a maximum temperature;

said arcuate portion having a profile conforming to the path of said free edge portion of said temperature responsive means with clearance therebetween when said temperature responsive means is between said first position and said second position for providing a minimum, substantially constant gas flow area between said first temperature and said intermediate temperature.

* * * * *

UNITED STATES PATENT AND TRADEMARK OFFICE

CERTIFICATE OF CORRECTION

PATENT NO. : 4,384,671

DATED : May 24, 1983

INVENTOR(S) : Thomas E. Hayes

It is certified that error appears in the above—identified patent and that said Letters Patent is hereby corrected as shown below:

Column 7, line 1, change "of" to -- at --.

Signed and Sealed this

*Sixteenth* Day of *August 1983*

[SEAL]

*Attest:*

GERALD J. MOSSINGHOFF

*Attesting Officer*

*Commissioner of Patents and Trademarks*